US005553438A

United States Patent [19]

Hsu

[11] Patent Number: 5,553,438

[45] Date of Patent: Sep. 10, 1996

[54] METHODS OF EXTENDING WOOD POLE SERVICE LIFE

[75] Inventor: Wu-Hsiung E. Hsu, Ottawa, Canada

[73] Assignee: Forintek Canada Corp., Vancouver, Canada

[21] Appl. No.: 276,249

[22] Filed: Jul. 18, 1994

[51] Int. Cl.[6] ..... E04C 3/36

[52] U.S. Cl. ..... 52/736.4; 52/730.7; 52/737.5; 52/738.1; 52/170

[58] Field of Search ..... 52/170, 309.15, 52/730.7, 736.3, 736.4, 737.3, 737.5, 738.1

[56] References Cited

U.S. PATENT DOCUMENTS

| | | | |
|---|---|---|---|
| 910,356 | 1/1909 | Carpenter | 52/736.4 X |
| 1,593,330 | 7/1926 | DeLamare | 52/736.4 X |
| 2,139,422 | 12/1938 | Schmittutz | 52/170 |
| 2,570,588 | 10/1951 | Nylund . | |
| 3,362,124 | 1/1968 | Cravens . | |
| 4,244,156 | 1/1981 | Watts, Jr. | 52/736.4 X |
| 4,443,990 | 4/1984 | Johnson . | |
| 4,644,722 | 2/1987 | Phillips . | |
| 4,697,959 | 10/1987 | Kinnan . | |
| 4,702,057 | 10/1987 | Phillips . | |
| 4,779,389 | 10/1988 | Landers . | |
| 4,799,340 | 1/1989 | Lichau . | |
| 4,892,601 | 1/1990 | Norwood . | |
| 4,918,883 | 4/1990 | Owen et al. | 52/736.4 X |
| 4,921,555 | 5/1990 | Skiff . | |
| 5,138,806 | 8/1992 | Marx et al. | 52/737.5 X |
| 5,320,152 | 6/1994 | Ganley | 52/730.7 X |

FOREIGN PATENT DOCUMENTS

| | | | |
|---|---|---|---|
| 2324139 | 4/1977 | France | 52/309.15 |

*Primary Examiner*—Carl D. Friedman
*Assistant Examiner*—Yvonne Horton-Richardson
*Attorney, Agent, or Firm*—Barnes & Thornburg

[57] ABSTRACT

The service life of wooden poles such as utility poles is increased by forming the butt end portion thereof with slots that penetrate deeply into the wood, these slots being formed prior to pressure treatment of the wood with preservatives and thus improving the penetration of the preservatives into the wood. After drying, the butt end of the pole is encased in a shell, suitably of polymers, that is bonded to the butt of the pole and presents a barrier to the penetration of fungus or insects, and likewise prevents the passage of liquids which might leach preservative from the pole into the surrounding ground.

11 Claims, 1 Drawing Sheet

METHODS OF EXTENDING WOOD POLE SERVICE LIFE

BACKGROUND OF THE INVENTION a) Field of the Invention

The present invention relates to a method of treating wooden poles, particularly utility poles, to improve the service life thereof, and further relates to poles treated in this manner.

b) Description of the Prior Art

The treatment of wood products with preservatives is a necessary and common practice for the appropriate use of wood under service conditions that promote fungal and insect attack, e.g. in utility poles that have their butt ends buried in the ground. The most susceptible zone for decay in such a wooden pole is within two feet above and below the ground level, because in this zone the moisture content is frequently above 30% (which corresponds to the fiber saturation point of the wood) and sufficient oxygen is available.

In the prior art, wooden poles are typically air dried to an appropriate moisture content before pressure treatment with preservatives. The sapwood must be dried to a moisture content below the fibre saturation point to ensure adequate penetration and retention of the oil-borne preservative. However this does not necessarily preclude subsequent decay in service. The active ingredients of the preservative can break down and be released from the pole, and the preservatives lose their efficacy over time, and particularly after long service in the field. Such release of preservative to the ground could have a negative impact on the environment, so that in some areas the use of such treated wooden poles is not permitted.

Additionally it is well known that wood shrinks as it becomes drier, so that in service as the wooden pole dries checks develop, and these checks are often deep enough to provide passage for wood destroying fungi or insects to penetrate into the core region of the pole, beyond the zone that has been impregnated with the preservative. Damage as a result of storms or impacts such as traffic accidents can also occur.

Eventually all wood poles have to be replaced or repaired after a period of years which varies according to some of the conditions outlined above. Typically, the life expectancy of a utility pole is within the range 30 to 40 years. Since the number of wooden utility poles in use in Canada and the U.S.A. is conservatively estimated to,be over one hundred million, the replacement rate for such poles must amount to several million per year.

It will be appreciated that to replace a utility pole and transfer facilities from an old pole to-the replacement pole is very costly, especially for a pole that supports power transmission lines. Additionally, where a new transformer is required in a given area, it is clearly less expensive to install it on an existing pole than to erect a new pole, but this cannot be done if the existing pole has deteriorated to the extent that it is not strong enough to support the transformer.

In view of the large number of poles in use, any measure to upgrade and extend the service life of such poles will result in large savings in labour and material costs.

SUMMARY OF THE INVENTION

The present invention accordingly provides a wooden pole that is adapted to be erected with a bottom end section thereof buried in the ground, comprising: slot means extending longitudinally of the pole over substantially the entire length of said bottom end section to a distance that will extend at least one and one half feet above ground level when said pole is installed, said slot means Comprising slot portions that open from the peripheral surface of the pole at a plurality of locations spaced angularly about said peripheral surface, each said slot portion penetrating said pole to a depth of at least 2 inches, and at least some of said slot portions penetrating at least half the distance from said peripheral surface to the center of the pole, said pole, including surfaces thereof that define said slot means, being impregnated with rot-inhibiting preservative, the entire lower end of the pole to a height beyond the location of said slot means being enveloped in a non-degradable shell that is bonded to the peripheral and lower end surfaces of the pole to provide a barrier to the passage of liquids, fungus, bacteria, or insects. The shell is preferably also designed to reinforce the bottom section of the wooden pole, which has been weakened by the slot means.

The slot means is preferably a diametral through slot that opens from the lower end face of the pole and extends continuously to a location of between two and four feet above the intended ground level. Additional slots of kerfs may be provided e.g. at locations 90 degrees offset from the through slot. It will be understood that such slots and kerfs substantially assist the penetration of preservatives into the wood of the pole, without however excessively reducing the strength or structural integrity of the pole. Furthermore, by providing such slots or kerfs the tendency of checks to develop at other locations in the pole as it dries is very much diminished.

The shell can be of any suitable material, typically a thermoplastic material sheeting or film that is bonded to the surface of the pole by an adhesive resin such as an isocyanate, a polyurethane, or a polyester. The shell may alternatively be of a synthetic cloth, a plastic/wood sheeting, or a laminated wood veneer sheeting. In all cases the shell is of such a nature that it provides a barrier to the passage of liquids, fungi or insects.

The shell preferably retains a degree of deformability so as to be able to accommodate temperature- or moisture-induced variations in the pole dimensions without developing cracks.

The protective shell may be covered by a rigid reinforcing casing extending at least over a few feet above the ground level to reduce damage to the shell and the pole through impact with automobiles or other equipment. The reinforcing casing is preferably of a corrosion resistant sheet metal and is preferably bonded to the shell.

From another aspect the invention provides a method for improving the serviceability of a wooden pole that is to be erected with a bottom end section of the pole adjacent the butt end thereof being buried in the ground, said method comprising: (a) forming slot means in said pole, said slot means extending longitudinally thereof throughout and somewhat beyond said section and penetrating at least one third the distance from the surface of the pole to the center thereof, said slot means having portions that open from the peripheral surface of the pole at a plurality of angularly spaced locations thereon; (b) pressure treating said pole with a rot-inhibiting preservative; (c) drying the pressure treated pole to a desired moisture content; (d) enveloping said bottom end section of the pole to a height beyond said slot means in a non-degradable shell, and bonding said shell to the peripheral and end surfaces of the pole to present a barrier to the passage of liquids, fungus or insects.

The shell may be a plastic shell bonded to the pole by a suitable adhesive resin, and in some applications it may be desirable to encase at least part of the length of the shell in a reinforcing metal casing.

BRIEF DESCRIPTION OF THE DRAWINGS

The invention will further be described, by way of example only, with reference to the accompanying drawings wherein.

DESCRIPTION OF THE PREFERRED EMBODIMENTS

Figure 2:
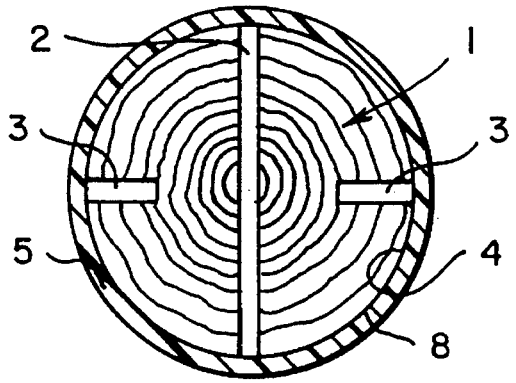
FIG. 2 is a cross-sectional view taken on the line II—II in FIG. 1.
Figure 1:
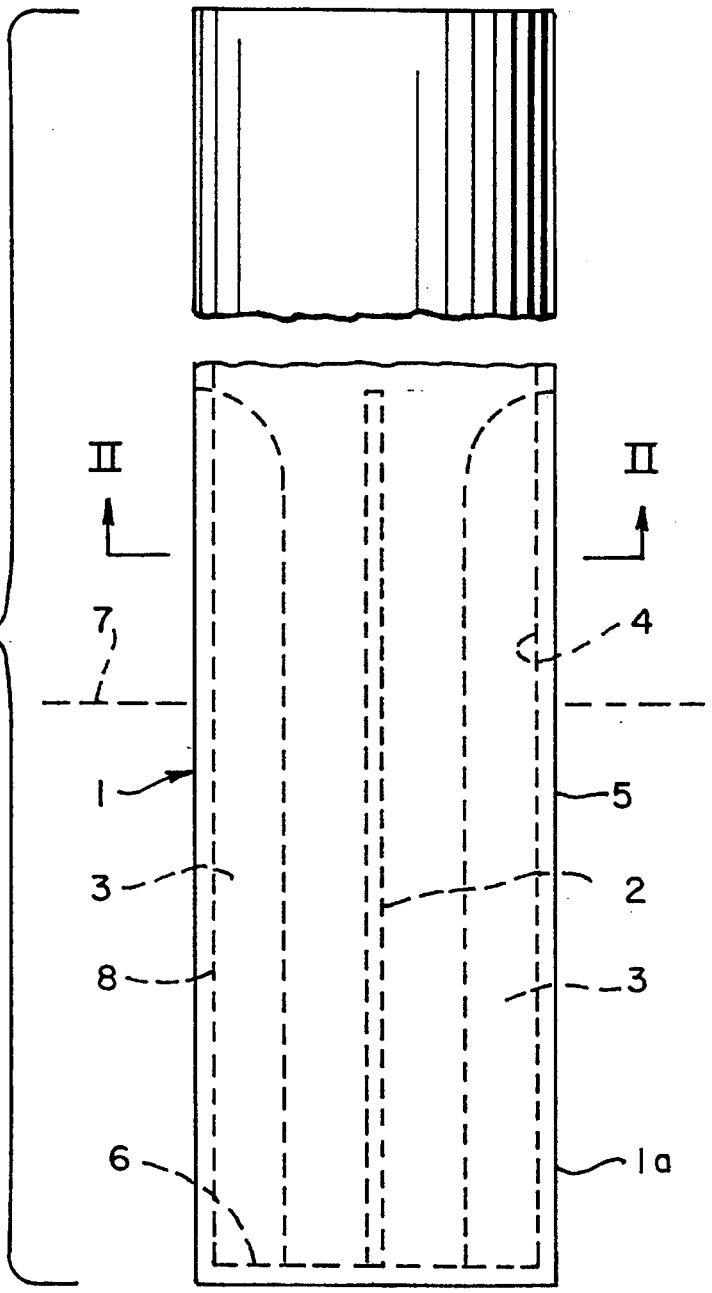
FIG. 1 is a foreshortened somewhat schematic elevational view of a wooden utility pole, showing details of the butt end section thereof.

The wooden utility pole 1 illustrated in the drawings as being cylindrical, will in practice usually taper slightly in diameter from bottom to top since it is made from a tree trunk. The wooden pole 1 is specially protected before it is installed, with the object of enhancing the service life of the pole. As shown, a diametral through slot 2 opening from the butt end surface 6 of the pole extends continuously through the lower or butt end section of the pole to a height that is between about 2 and 4 feet above the intended ground level of the pole when installed, indicated by the broken line 7 in FIG. 1. Angularly spaced from the slot 2 and opening from the peripheral surface 4 of the pole are a pair of diametrically opposed kerfs 3 which extend part way to the center region of the pole, typically between ⅓ and ½ of the radius of the pole. In the embodiment shown, these kerfs 3 are angularly spaced by 90 degrees from the through slot 2. In larger diameter poles additional kerfs may be provided. The width of the kerfs and slots will typically be about one-eighth of an inch.

After forming the slots 2 and 3 in the butt end section 1*a* of the pole as described above, the pole having been dried to a desired moisture content, is subjected to impregnation of a rot-inhibiting preservative and fungicide mixture by liquid pressure treatment. The wood has to be dried to below the fibre saturation point (about 30% moisture content) thereof to ensure adequate penetration and retention of the preservative compounds of oil-borne preservatives are used. However, when water-borne preservatives are to be used, seasoning below the fiber saturation point before treatment is less important.

After the pressure treatment step, the pole is dried to a suitable moisture content by kiln drying or by air drying, and thereafter the butt end section of the pole is treated to provide a non-degradable shell therearound. As a first step, the exposed peripheral and end surfaces of the pole butt section are coated with a thermoplastic resin, preferably a hot-melt glue 8 which provides good adhesion to wood and remains flexible and stretchable after cooling. Other suitable glues include polyurethane- and isocyanate-based adhesives, epoxy resin adhesives and polyester resin. The glue adheres to the exposed surfaces of the pole, and may partially fill the open sides of the slots 2 and 3. Thereafter, the coated butt end section of the pole is wrapped in a layer of non-degradable thermoplastic material 5 which wraps around the exposed peripheral surface 4 and end surface 6 of the pole and is bonded thereto by the glue coating 8.

The particular material used for the glue coating 8 will depend on the moisture content of the section of the pole that is being protected. If the moisture content is over 20%, isocyanate or polyurethane resins are preferred. If the moisture content is lower than 20%, other resins such as hot melt glue epoxy and polyester resins can also be used.

The plastic layer 5 can take many suitable forms, for example it may comprise a flexible thermoplastic sheet, a plastic/wood sheet, synthetic cloth, or a thin laminated veneer sheet, or any combination of such materials. If a laminated veneer sheet is used, it should be pressured treated with adequate preservatives.

The shell layer 5 can be moulded from thermoplastic material and can be of any desired strength. The sheel will reinforce the butt end region of the pole, completely compensating for the weakening effect of the kerfs and slot.

From the foregoing it will be understood that the specific materials used for the glue coating 8 and the plastic layer 5 can very widely according to conditions, as long as they meet the objective of providing a durable protective shell that acts as a barrier to the passage of liquids, fungi and insects. This shell preferably extends upwardly to a point about 6 inches beyond the ends of the slots 2 and 3. To provide added protection to the pole against damage through accidental impact, e.g. as may be occasioned by machinery or vehicular traffic, the shell 5 can be enclosed within a reinforcing metal casing (not shown). Typically the casing is made of a corrosion resistant sheet metal and extends in the region of the ground level 7, to a height of several feet thereabove. The space between this casing and the length of the shell 5 that it surrounds is preferably filled with an epoxy resin or isocyanate-based bonding agent which bonds the casing to the shell. Of course the material of the casing and of the shell should be such as to be able to accommodate normal temperature induced dimensional changes of the wooden pole without creating cracks or breaks in the shell.

The embodiments of the invention in which an exclusive property or privilege is claimed are definer as follows:

1. A wooden pole that is adapted to be erected with a bottom end section thereof buried in the ground, comprising:

slot means extending longitudinally of the pole over substantially the entire length of said bottom end section to a distance that will extend at least two feet above ground level when said pole is installed, said slot means comprising slot portions that open from the peripheral surface of the pole at a plurality of locations spaced angularly about said peripheral surface, each said slot portion penetrating said pole to a depth of at least 2 inches, and at least some of said slot portions penetrating at least half the distance from said peripheral surface to the center of the pole, said pole, including surfaces thereof that define said slot means, being impregnated with rot-inhibiting preservative, the entire bottom end section including the lower end surface of the pole to a height beyond the location of said slot means being enveloped in a non-degradable shell that is bonded to the peripheral and lower end surfaces of the pole to provide a barrier to the passage of liquids, fungus, bacteria, or insects.

2. A pole as claimed in claim 1 wherein said slot means comprises a diametral through slot opening from the lower end surface of the pole and extending substantially continuously to a location at least two feet but not more than about four feet beyond the intended ground level of the pole when installed.

3. A pole as claimed in claim 2 wherein said slot means includes at least two kerfs in said pole extending over substantially the same length as said through slot and having a depth of between one third and one half the distance from the surface to the center of the pole.

4. A pole as claimed in claim 3 wherein said kerfs are positioned in substantially opposed locations.

5. A pole as claimed in claim 1 wherein said shell is bonded to said pole by a suitable polymeric material.

6. A pole as claimed in claim 5 wherein said polymeric material is an adhesive resin based on the material selected from the group isocyanate, polyurethane, epoxy and polyester.

7. A pole as claimed in claim 1 wherein said shell is formed of a flexible material selected from the group:

thermoplastic sheeting; synthetic cloth or film; plastic/wood sheeting; and laminated wood veneer sheeting.

8. A pole as claimed in claim 6 wherein said shell is of a molded thermoplastic composition.

9. A pole as claimed in claim 1 wherein said shell is enclosed by a rigid reinforcing casing which extends over a length of the pole that corresponds at least to a region in the vicinity of and above the intended ground level.

10. A pole as claimed in claim 9 wherein said rigid reinforcing casing is of metal.

11. A pole as claimed in claim 9 wherein said reinforcing casing is bonded to said shell.

* * * * *